United States Patent [19]

Oliver

[11] 4,111,261

[45] Sep. 5, 1978

[54] WELLHEAD ISOLATION TOOL

[75] Inventor: Owen Norman Oliver, Duncan, Okla.

[73] Assignee: Halliburton Company, Duncan, Okla.

[21] Appl. No.: 777,379

[22] Filed: Mar. 14, 1977

[51] Int. Cl.[2] ..... E21B 33/03; E21B 43/04; E21B 43/118

[52] U.S. Cl. ..... 166/86; 166/70; 166/90

[58] Field of Search ..... 166/80, 85, 90, 202, 166/86, 76, 77, 70; 51/439; 239/591, 589, 601

[56] References Cited

U.S. PATENT DOCUMENTS

| | | | |
|---|---|---|---|
| 1,252,426 | 1/1918 | Gnade | 166/242 |
| 2,672,199 | 3/1954 | McKenna | 166/202 |
| 2,868,512 | 1/1959 | Sease | 175/340 |
| 3,469,642 | 9/1969 | Goodwin et al. | 239/601 X |
| 3,620,457 | 11/1971 | Pearson | 239/601 X |
| 3,830,814 | 8/1974 | Cummins | 166/80 X |
| 3,905,553 | 9/1975 | Bradley et al. | 239/601 |
| 4,023,814 | 5/1977 | Pitts | 166/75 R |

*Primary Examiner*—Ernest R. Purser
*Assistant Examiner*—William F. Pate, III
*Attorney, Agent, or Firm*—John H. Tregoning; James R. Duzan

[57] ABSTRACT

Improved apparatus for isolating a production tubing string in an oil well from the control head whereby pressures higher than the pressure of the control head may be applied through the production tubing string to the producing formation. The apparatus utilizes an outer housing with a telescoping inner mandrel and seals therebetween, with the outer housing being adapted for connection to the control head and the inner mandrel being capable of moving into the control head to make a fluid-tight sealed connection with the production tubing thereby isolating the control head from the higher pressure being applied through the tubing into the formation. The improved apparatus further provides an elongated divergent passage at the lower end of the telescoping inner mandrel for providing a gradual increase in cross-sectional area between the interior of the telescoping inner mandrel and the interior of the upper end portion of the production tubing string to reduce turbulence in high pressure fluid passing downwardly therethrough and thereby reduce to a minimum the incidence of erosion of the inner surface of the tubing string adjacent to the sealed connection between the inner mandrel and the tubing string.

8 Claims, 11 Drawing Figures

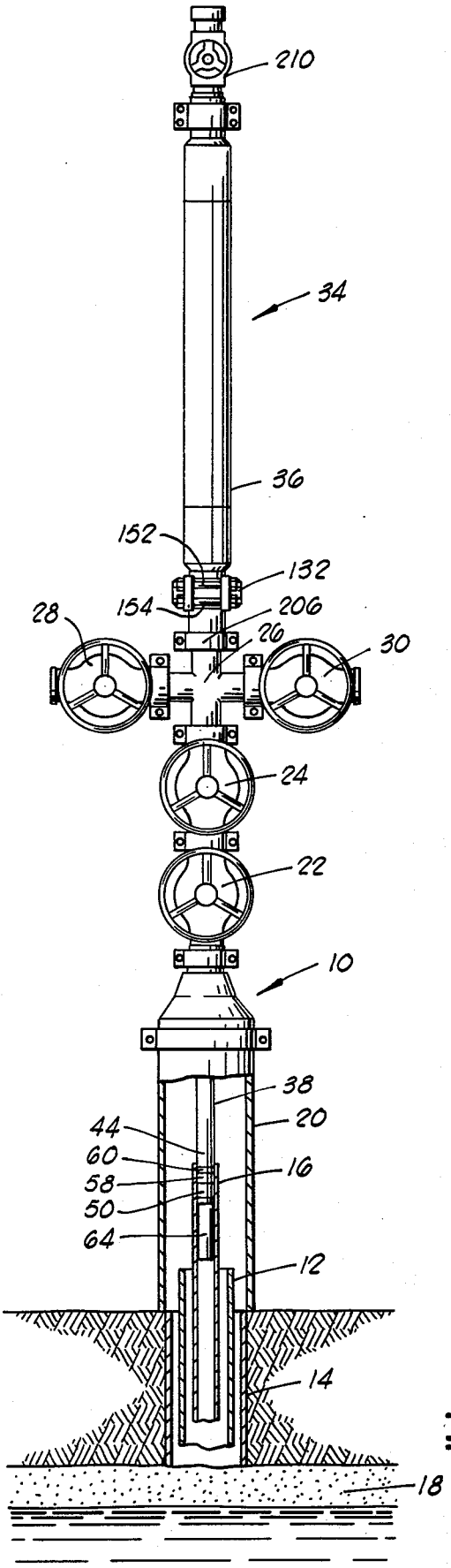
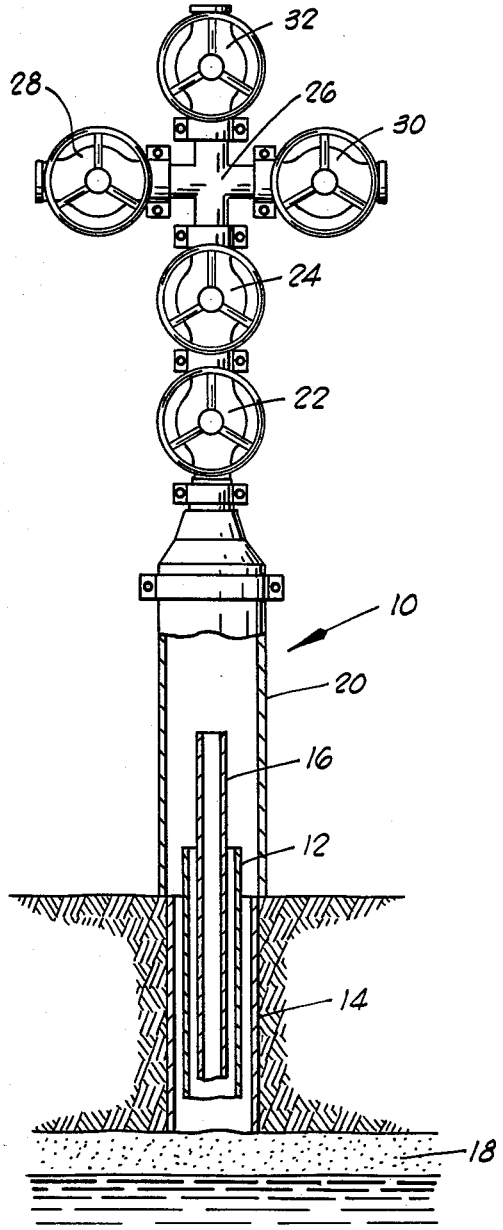
FIG. 1
FIG. 3

WELLHEAD ISOLATION TOOL

During the life of most producing oil wells, it often becomes desirable to further treat the well to enhance and increase production. Typically this involves the application of an acidic solution to the producing formation under pressure or the application of a hydraulic solution to the formation under extremely high pressure in order to fracture the formation and increase the flow of hydrocarbons therefrom. In order to take a well off production and achieve the required acidizing or fracturing treatment, or any other suitable treatment, it was necessary in the past to remove the wellhead from the well and tie into the production tubing. In order to remove the wellhead and tie into the production tubing, it was necessary to kill the well. This process involved the pumping of fluid, such as mud or water, into the well until a sufficient amount of hydrostatic pressure or head was obtained from the fluid column to overcome the pressure of the formation and prevent the blowing out of well fluids or formation fluids from the well. The killing process involves great expense, time and labor and, therefore, creates a highly undesirable situation.

U.S. Pat. No. 3,830,304, entitled "Wellhead Isolation Tool and Method of Use Thereof", issued to Alonzo E. Cummins and assigned to Halliburton Company, Duncan, Oklahoma, discloses a wellhead isolation tool which overcomes the previously mentioned problems encountered when treatment of an oil well is necessary. The apparatus disclosed provides means for directly communicating with production tubing without necessitating the removal of the wellhead controls from the well or the killing of the well or the swabbing of the well after treatment. The apparatus of the Cummins patent overcomes the previously mentioned disadvantages of the prior art by providing an inner high pressure mandrel and an outer high pressure casing, with the casing being adapted for sealing contact with the wellhead, and with the inner mandrel being adapted for selective sealing engagement with the upper end portion of the production tubing. The inner mandrel of the Cummins apparatus is provided with means for extending and retracting the mandrel through the wellhead without necessitating the removal of the wellhead and the killing of the well.

As the apparatus of the Cummins patent has found increasing use in the oil industry, increased pressure and fluid flow demands have been placed on the equipment. Of particular significance are the increased pressure and fluid flow requirements placed on the equipment when sand laden fracturing fluids are pumped at extremely high pressures and flow rates through the equipment into the production tubing string. It has been found that the abrupt change in cross-sectional area between the interior of the inner mandrel and the interior of the upper end portion of the production string at these high flow rates induce an extreme amount of turbulence in the sand laden fluid passing therethrough which often causes damaging erosion to the inner surface of the upper end portion of the tubing string.

The improvements embodied in the present invention overcome the limitations of the prior art apparatus employed in wellhead isolation and provide significant reduction in the incidence of erosion of the inner surface of the production tubing string under high pressure and flow conditions. The present invention contemplates a divergent passage positioned below the lower end portion of the high pressure inner mandrel and having an upper end portion, a lower end portion and a medial portion extending between the upper and lower end portions. The inner diameter of the upper end portion of the divergent passage is equal to the diameter of the bore of the high pressure inner mandrel while the inner diameter of the lower end portion of the divergent passage is only slightly less than the diameter of the interior of the upper end portion of the oil well production tubing string. The medial portion of the divergent passage defines a diverging inner surface mutually communicating with and extending downwardly from the inner diameter of the upper end portion to communicate with the inner diameter of the lower end portion of the divergent passage. The improved structure also provides means for connecting the divergent passages to the lower end portion of the high pressure inner mandrel with the inner diameter of the upper end portion of the divergent passage coaxially communicating with the bore of the high pressure inner mandrel. Also, an annular seal carried by the lower end portion of the high pressure inner mandrel is provided proximate to the divergent passage for providing sealing engagement with the interior of the upper end portion of the oil well production tubing string.

FIG. 1 is a partial vertical cross-sectional view schematically illustrating a wellhead positioned upon a well and the associated underground formation.

Figures 2A, 2B, 2C:
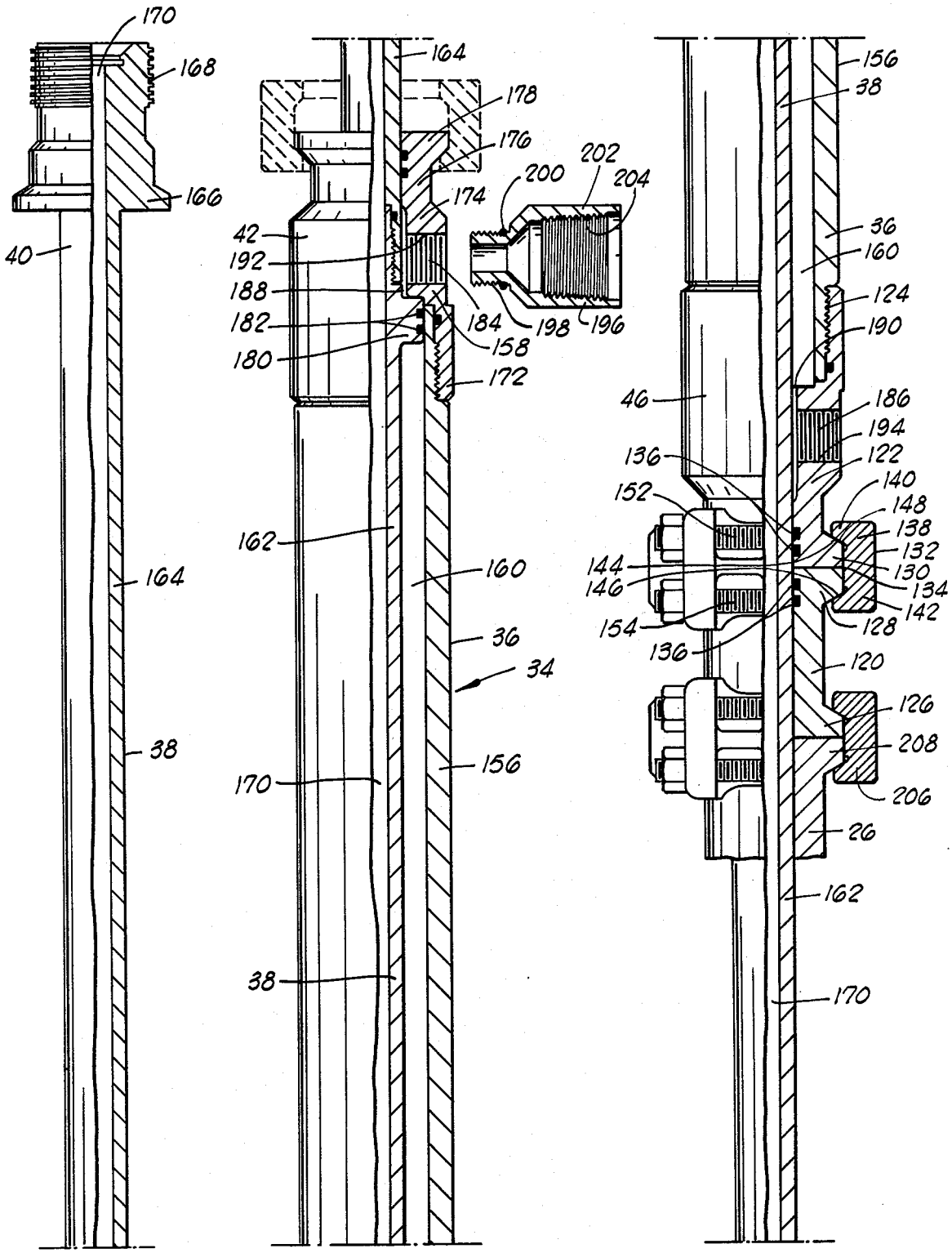
FIG. 2A is a partial vertical cross-sectional view illustrating the upper end portion of the apparatus of the present invention.
Figure 2D:
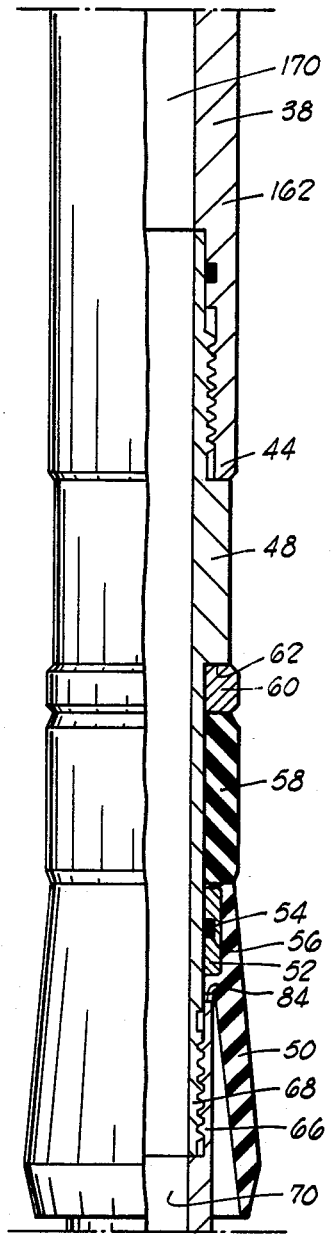

FIG. 2B is a continuation of FIG. 2A and is a partial vertical cross-sectional view illustrating the upper medial portion of the apparatus; FIG. 2C is a continuation of FIG. 2B and is a partial cross-sectional view illustrating the medial portion of the apparatus; FIG. 2D is a continuation of FIG. 2C and is a partial vertical cross-sectional view illustrating the lower medial portion of the apparatus; and FIG. 2E is a continuation of FIG. 2D and is a partial vertical cross-sectional view illustrating the lower end portion of the apparatus.

FIG. 3 is a partial cross-sectional view schematically illustrating the wellhead of FIG. 1 with the apparatus of the present invention installed thereon and providing communication with the production tubing.

Figure 2E:
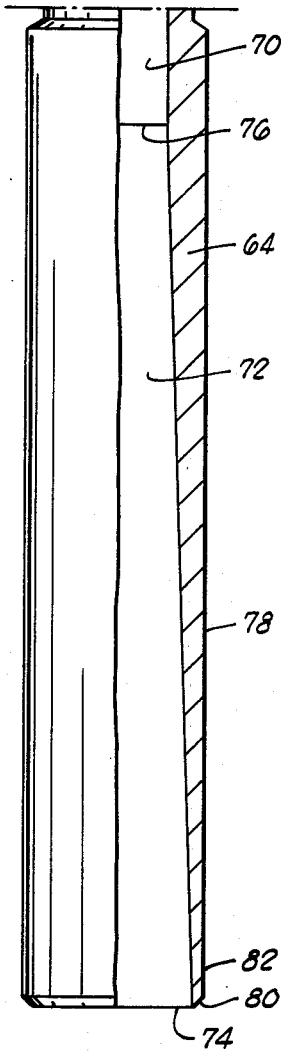
Figure 4:
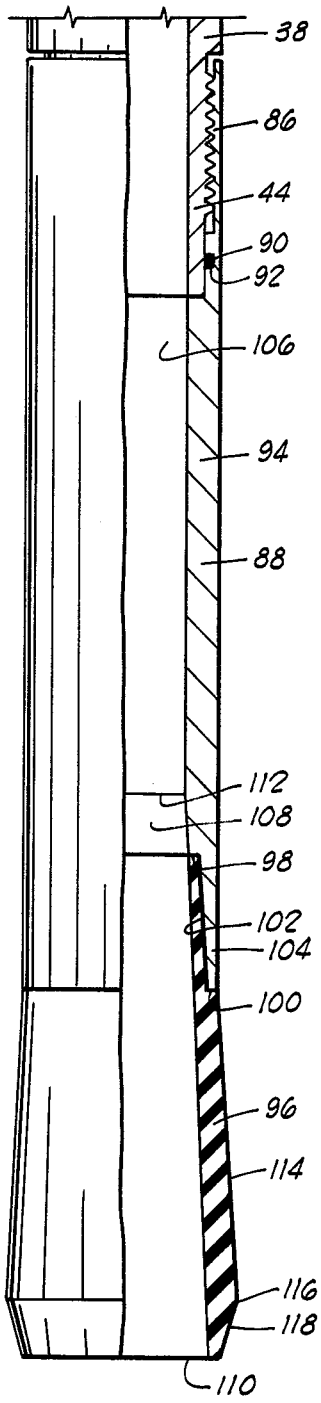

FIG. 4 is a partial vertical cross-sectional view similar to FIGS. 2D and 2E and illustrates an alternate embodiment of the present invention.

Referring now to the drawings, and to FIG. 1 in particular, a normal producing well is schematically illustrated therein and is designated by the reference character 10. The well 10 comprises casing 12 passing into the ground, ground casing 14 disposed concentrically around the casing 12, and a production tubing string 16 disposed concentrically within the casing strings 12 and 14 and communicating with a producing formation 18 located below the ground surface. Disposed above the ground surface, and connected to the ground casing 14 is a wellhead 20 comprising a lower valve 22, an intermediate valve 24, a tee valve or control cross member 26 including wing valves 28 and 30, and upper valve 32.

Referring now to FIGS. 2A, 2B, 2C, 2D and 2E, the wellhead isolation tool 34 constructed in accordance with the present invention is illustrated in the initial position or orientation. The tool 34 comprises a tubular cylindrical outer housing 36 constructed of relatively strong material preferably rated to withstand pressures in excess of 20,000 psi. Located concentrically and slidably within the housing 36 is a high pressure inner mandrel 38 in the form of a tubular cylindrical member extending completely through the housing 36 with the upper end portion 40 of the mandrel 38 extending above the upper end portion 42 of the housing 36 and with the lower end portion 44 of the mandrel 38 extending below the lower end portion 46 of the housing 36. Mounted on the lower end portion 44 of the mandrel 38, in threaded sealing engagement therewith, and formed a part thereof, is a seal collar 48 having an inner diameter equal to the inner diameter of the inner mandrel 38. A sealing cup 50, preferably formed of a resilient elastomeric material, and bonded to an annular member 52, is disposed about the seal collar 48 in coaxial alignment therewith. An annular seal 54 disposed within an annular groove 56 formed in the inner surface of the annular member 52 provides sealing engagement between the annular member 52 and the seal collar 48. Positioned above the sealing cup 50, and disposed about the seal collar 48, is a resilient packer ring 58 which may be suitably formed of an elastomeric material. An annular packer shoe 60 is disposed about the seal coolar 48 intermediate the packer ring 58 and a radial shoulder 62 formed on the seal collar 48. The packer shoe is preferably formed of a relatively hard metallic material.

A tubular guide nose 64 is threadedly secured at its upper end portion 66 to the lower end portion 68 of the seal collar 48. The guide nose 64 may be suitably formed of 4140 heat treated steel tubing. The interior 70 of the upper end portion of the tubular guide nose 64 is cylindrically shaped and has an inner diameter equal to the inner diameter of the seal collar 48. A frusto-conically shaped divergent passage 72 extends downwardly from the interior 70 to communicate with the lower end face 74 of the tubular guide nose 64. The upper end 76 of the divergent passage 74 has an inner diameter equal to the inner diameter of the cylindrical interior surface 70 of the guide nose 64. The diverging inner surface of the divergent passage 72 defines a frusto-conically shaped surface gradually and uniformly diverging from the axis thereof at an angle of not more than 3°, and, preferably, approximately 2°. Stated another way, the frusto-conically shaped surface defined by the divergent passage 72 has an apical angle of no more than 6° and preferably approximately 4°. The cylindrical outer surface 78 of the guide nose 64 has a diameter which, though slightly less than the inner diameter of the upper end portion of the production tubing string 16, is for practical purposes substantially equal to the inner diameter of the production tubing string. A beveled annular surface 80 is formed on the lower end portion 82 of the guide nose 64 and extends between the lower end face 74 and the cylindrical outer surface 78 to facilitate the entrance of the guide nose 64 into the interior of the upper end portion of the production tubing string 16. An upper end face 84 is formed on the upper end portion 66 of the guide nose 64 to engage and retain the sealing cup 50 in position on the seal collar 48 when the guide nose 64 and the seal collar 48 are threadedly engaged as mentioned above.

The previously described improved construction of the inner mandrel 38 with the seal collar 48 and tubular guide nose 64 assembled thereon together with the sealing cup 50 and packer ring 58 permits a substantially enlarged inner diameter of the mandrel 38, seal collar 48 and cylindrical interior surface 70 of the guide nose 64 to facilitate higher rates of fluid flow therethrough, in excess of ten barrels per minute, accompanied by higher percentages of sand in the fracturing fluid being passed therethrough. The 2° angle of divergence of the conically shaped divergent passage 72 provides a very gradual, uniform increase in cross-sectional area and decrease in velocity of fluid flow in the transition from the inner diameter of the mandrel to the inner diameter of the divergent passage 72 at the lower end face 74 which is substantially equal to the inner diameter of the upper end portion of the production tubing string. This gradual decrease in velocity of the fluid, for example, a sand laden gelled liquid such as VERSAGEL, provided by the 2° angle of divergence of the passage 72 substantially eliminates damaging erosion of the production tubing string caused by sand turbulence by providing sufficient flow velocity transition time to permit sand particles, which are transported at a relatively constant velocity within the moving column of gelled liquid and spaced inwardly from the wall of the bore through the mandrel 38, to gradually decelerate through the passage 72 and approach the interior surface of the tubing string at a lower velocity without being violently impacted from behind by following sand particles exiting the mandrel at higher velocity and inducing violet sand turbulence, even at high pumping rates of, for example, 17 or 18 barrels per minute.

Referring now to FIG. 4, a second embodiment of the improved wellhead isolation tool of the present invention is disclosed therein. The lower end portion 44 of the inner mandrel 38 is threadedly secured to the upper end portion 86 of a cup assembly 88. A suitable annular seal 90 carried in an annular groove 92 formed in the upper end portion 86 of the cup assembly 88 provides a fluid-tight seal between the cup assembly 88 and the lower end portion 44 of the inner mandrel 38. The cup assembly 88 comprises a relatively rigid tubular upper portion 94 and a resilient tubular lower portion 96. The upper portion 94 may be suitably formed of a rigid metallic material such as 4140 steel tubing. The resilient lower portion 96 may be suitably formed of a resilient elastomeric material, such as synthetic rubber of approximately 85 durometer. The elastomeric material is preferably molded and chemically bonded to the upper portion 94 along radial shoulders 98 and 100 and interconnecting circumferential surface 102 on the lower end portion 104 of the upper portion 94. When so mutually bonded, the upper and lower portions 94 and 96 form the unitary cup assembly 88.

The upper portion 94 of the cup assembly 88 is provided with a cylindrical inner surface 106 which coaxially communicates at the upper end thereof with the cylindrical inner surface of the inner mandrel 38. The inner diameters of the inner surface 106 of the upper portion 94 and the inner surface of the inner mandrel 38 are preferably equal. A frusto-conically shaped divergent passage 108 extends downwardly from the cylindrical inner surface 106 to communicate with the lower end face 110 of the resilient lower portion 96. The upper end 112 of the divergent passage 108 has an inner diameter equal to the inner diameter of the cylindrical inner surface 106. The smoothly and uniformly diverging inner surface of the divergent passage defines a frusto-conically shaped surface disposed within both the rigid upper portion 94 and resilient lower portion 96 and diverging from the axis thereof at an angle of no more than 3°, and preferably approximately 2°, when the resilient lower portion 96 is in a relaxed position. Alternatively, the frusto-conically shaped divergent passage 108 defines a frusto-conically shaped surface having an apical angle of no more than 6°, and, preferably, approximately 4°. The outer surface 114 of the resilient lower portion 96 forms a downwardly divergent frusto-conical surface from the radial shoulder 110 of the rigid upper portion 94 to communicate with a circumferential contact surface 116 to form an annular sealing surface on the exterior of the resilient lower portion 96 to sealingly engage the interior surface of the upper end portion of the production tubing string. A beveled annular surface 118 communicates between the circumferential contact surface 116 and the lower end face 110 of the resilient lower portion 96 to facilitate the introduction of the cup assembly 88 into the interior of the upper end portion of the production tubing string. It will be understood that the outer diameter of the circumferential contact surface 116 is slightly greater than the inner diameter of the interior of the upper end portion of the production tubing string when the lower portion 96 is in the relaxed position.

The embodiment of the wellhead isolation tool illustrated in FIG. 4 will be seen to maintain substantially the same angle of discharge of fluid passing therethrough as that previously described for the tubular guide nose 64. It will be noted that the cup assembly 88 provides certain advantages over the previously described wellhead isolation tool of FIG. 2. One advantage resides in the location of the sealing portion of the cup assembly 88 on the lowermost end of the mandrel which permits the cup assembly 88 to sealingly engage the upper end portion of the production tubing string with a shorter travel stroke of the cup assembly and the mandrel. Another advantage of the cup assembly 88 resides in the fact that its design permits the utilization of tubing members of thinner wall construction to thereby maximize the inner diameter of the mandrel 38 when conditions require a relatively larger volume of fluid flow therethrough but at a somewhat reduced pressure. It will be understood that the larger the inner diameter of the mandrel and cup assembly, the lower the linear fluid velocity therethrough for a given volume of fluid flow, and the less the cross-sectional transition between the inner diameter of the mandrel and cup assembly and the inner diameter of the production tubing string.

Referring again to FIG. 2E, it should be noted that in a preferred embodiment, the frusto-conically shaped divergent passage 72 diverges from an inner diameter of approximately 1.06 inches at the upper end 76 to an inner diameter of approximately 1.61 inches at the lower end face 74 through a longitudinal distance of approximately 9.06 inches. Referring to FIG. 4, a preferred embodiment of the cup assembly 88 is characterized by a frusto-conically shaped diverging passage 108 having an inner diameter of approximately 1.31 inches at the upper end 112 and diverging to an inner diameter of approximately 1.70 inches at the lower end face 110 through a longitudinal distance of approximately 5.58 inches, when the resilient lower portion 96 is in a relaxed condition. In both embodiments of the improved wellhead isolation tool of the present invention, these size relationships remain substantially constant through various sizes of tools for use with production tubing strings of various inner diameters. Also, it should be understood that the closer the inner diameter of the divergent passage 72 at the lower end face 74 approaches a diameter substantially equal to the inner diameter of the production tubing string the less the possibility of inducing tubulence in the fluid passing through the passage 72 at high pumping rates. Simiarly, the selection of an inner diameter of the divergent passage 108 at the lower end face 110 substantially equal to the inner diameter of the upper end portion of the production tubing string will also minimize induced turbulence in fluid passing through the divergent passage 108. While the size relationships set forth above for two forms of preferred embodiments have proved advantageous, it should be understood that under suitable circumstances the maximum inner diameters of the divergent passages should, as an optimum, be substantially equal to the inner diameter of the respective tubing strings in which they are to be received.

Referring again to FIGS. 2A, 2B and 2C, the lower end portion 46 of the housing 36 is characterized further as comprising a lower adapter 120 which is attached to a threaded upper adapter 122 which is, in turn, threadedly secured by means of threads 124 to the central section of the housing 36. The lower adapter 120 comprises a cylindrical tubular member having attachment flange means 126 located peripherally around the lower end of the adapter 120 and extending radially outwardly therefrom. The adapter 120 also includes an upper adapter flange 128 integrally formed thereon and providing attachment means to a lower attachment flange 130 of the upper adapter 122. A conventional type bolt clamp 132 is illustrated in clamping arrangement whereby flanges 128 and 130 are drawn together in sealing engagement. Annular seal means 134 may be positioned between the flanges 128 and 130 to enhance the fluid-tight seal therebetween. Annular seals 136 located in corresponding annular grooves formed in the adapters 120 and 122 provide sealing engagement between the adapters and the inner mandrel 38.

The previously mentioned flange 126 is provided for attaching the wellhead isolation tool 34 to the wellhead 20. The flange 126 can be of the clamp type as shown at 128 and 130, or may be of the conventional bolt-through type (not shown). A further alternative attachment at the flange 126 would be a threaded type attachment with mating threads in the wellhead control tee. The purpose of the adapter 120 is to allow different types of flanging means to be utilized with the tool 34 without having to change the entire housing of the tool. Thus if a bolt type flange is available on the wellhead, the lower adapter 120 having the clamp type flange may be removed and a different lower adapter having the corresponding bolt type flange may be substituted therefor on the tool 34.

The clamp 34 comprises a hinged, multi-piece clamp having a circumferential body 138 with clamping wings or arms 140 and 142. These clamping arms form annular radially inwardly extending inclined shoulders along the front and rear ends of the circumferential clamp body 138. The clamping force which is provided by the wings 140 and 142 arises from the beveled or cam surfaces 144 and 146 thereof acting upon the corresponding cam or beveled surfaces 148 and 150 of the flanges 128 and 130. The cam surfaces 144 and 146 are drawn down upon the cam surfaces 148 and 150, thereby forcing the flanges 128 and 130 into abutting relation by the tightening of the two bolts 152 and 154, which tightening pulls the multi-piece clamp into circumferential engagement with the flanges 128 and 130. This clamp arrangement is well-known in the art, and the clamping devices may be readily obtained through commercial outlets.

The housing 36, comprising the lower adapter 120, upper adapter 122, central housing section 156 and top adapter 158, serves as the housing unit for the inner mandrel 38, as well as providing an annular piston space 160 between the housing 36 and the mandrel 38. The inner mandrel 38 comprises a lower tubular section 162 and an upper tubular section 164. While the tubular sections 162 and 164 may be integrally formed as one section, for convenience and ease of manufacturing it is deemed desirable to form the inner mandrel 38 from the tubular sections 162 and 164, as illustrated. A lock down clamping flange 166 and a threaded valve connection 168 are formed on the exterior of the upper end portion 40 of the upper tubular section 164. A cylindrical bore passage 170 communicates with the upper end of the upper tubular section 164 and extends downwardly therefrom through the entire length of the inner mandrel 38 forming an unhindered, unrestricted passage of constant cross-sectional area therethrough.

The upper adapter 158 of the housing 36 includes a lower internally threaded skirt section 172, an intermediate ported section 174 and an upper clamping section 176 having a lock down clamping flange 178 integrally formed thereon and extending radially outwardly therefrom. The clamping flange 178 is substantially identical in construction to the clamping flanges 128 and 130 on the lower end portion of the housing 36, and is also identical to the corresponding clamping flange 166 located on the upper end portion 40 of the inner mandrel 38. The clamping flanges 178 and 166 are arranged so that, upon downward movement of the inner mandrel 38 through the housing 36 to its lowermost point of travel, the flange 166 will come into abutment with the flange 178 whereupon a clamp, similar to the clamp 132 described in detail above, can be applied to the flanges 178 and 166 to mutually engage the flanges and thereby lock the inner mandrel 38 in the lowermost position within the housing 36. This locking arrangement of the clamping flanges 178 and 166 is illustrated in dashed lines in FIG. 2B.

A hydraulically actuated piston system is illustrated in FIG. 2B wherein the inner mandrel 38 carries upon its outer surface a circumferential piston shoulder 180 which moves vertically and longitudinally within the annular piston space 160 between the mandrel 38 and the housing 36. The piston shoulder 180 is provided with sealing elements 182 thereon which provide sliding sealing contact with the inner surface of the central housing section 156 of the outer housing 36. The shoulder 180 thereby provides a fluid barrier between the mandrel 38 and the housing 36. Operation of this hydraulic piston arrangement will be more particularly described hereinafter in conjunction with a description of the operation of the entire tool. Communication of fluids within the annular space 160 and the piston shoulder 180 is provided through upper and lower ports 184 and 186. Communication is provided from these ports to the annular space 160 through narrower annular spaces 188 and 190, respectively, extending between the ports 184 and 186 and the annular space 160. The ports 184 and 186 are further equipped with internal threads 192 and 194, respectively, for receiving either a threaded plug member (not shown) or a threaded adapter member 196 as shown. The threaded adapter member 196 is provided with external threads 198, an annular seal 200 for providing a fluid-tight seal connection in port 184 or 186, and an enlarged tubular section 202 having internal threads 204 adapted for receiving standard threaded tubing connectors (not shown). Thus, the adapter member 196 provides means for connecting a standard section of tubing into the ports 184 or 186 of the tool.

Referring now to FIGS. 2A, 2B, 2C, 2D, 2E and 3, operation of the improved wellhead isolation tool will be described in more particular detail. In FIGS. 2A, 2B, 2C, 2D and 2E, the wellhead isolation tool 34 is shown in its initial, unextended position as it will be when placed upon the wellhead 20. When it is desired to treat a well without having to kill it, the lower valve 22 can be closed off thereby closing in the well. The upper valve 32, as shown in FIG. 1, can then be removed from the wellhead 20 and the wellhead isolation tool 34 can be fixedly attached to the wellhead in substitution therefor. This can be done, as previously described, by placing a clamping member 206 about the flange 126 and the uppermost flange 208 of the tee valve assembly 26 of the wellhead 20, thus applying a clamping, sealing force similar to that achieved by the clamp 132 in conjunction with the flanges 128 and 130, as described in some detail above. Furthermore, a flat sealing ring with a beveled end may be placed between the flanges 126 and 208 thus providing further sealing engagement between the wellhead isolation tool 34 and the tee valve assembly or control cross 26.

After the wellhead isolation tool 34 is fixedly secured to the wellhead and suitably sealed thereto, the well is further closed in by means of the wellhead isolation tool 34. This is achieved through the utilization of a manually or automatically operable high pressure valve 210 (FIG. 3) attached to the external threads of the threaded valve connection 168 at the upper end portion 40 of the inner mandrel 38, with the valve 210 in its closed position. This closes off and seals the bore 170 through the inner mandrel 38, and allows the operator to selectively communicate fluid with the bore 170 through the valve 210. With the valve 210 mounted on the mandrel 38 and placed in its closed position, and with the wellhead isolation tool 34 sealingly secured to the upper end of the wellhead control cross 26, the lower valve 22 can then be opened while maintaining the well in a closed in position while simultaneously providing a straight through open bore in the wellhead through which the inner mandrel 38 can pass. Fluid pressure can then be applied through the adapter 196 and port 184 against the upper surface of the piston shoulder 180. The lower port 186 is preferably vented to atmospheric pressure, thereby communicating atmospheric pressure to that portion of the annular piston space 160 below the piston shoulder 180. The application of pressure through the port 184 results in a pressure differential across the piston 180 which, when of sufficient magnitude, will thereby drive the inner mandrel 38 downwardly, penetrating through the control cross 26, open intermediate valve 24 and open lower valve 22 and into the upper end portion of the production tubing string 16 as shown in FIG. 3. The introduction of the tubular guide nose 64, sealing cup 50, packing ring 58, packer shoe 60 and seal collar 48 on the lower end portion 44 of the mandrel 38 into the upper end portion of the production tubing string provides a fluid seal achieved by the sealing cup 50 and packer ring 58 between the bore 170, cylindrical interior surface 70, and divergent passage 72 and the inner surface or bore of the upper end portion of the production tubing string 16. The flanges 166 and 178 of the inner mandrel 38 and the outer housing 36 are then securely clamped together as described above.

Thus, pressurized fluid which may be applied within the bore 170 and the interior of the production tubing string is isolated from any of the apparatus on the control portion of the wellhead 20 and the housing 36.

At this point, the operator can attach high pressure fluid supply lines to the valve 210 attached to the upper end portion 40 of the inner mandrel 38, and cause the valve 210 to open to thereby supply high pressure fluids through the bore 170, cylindrical interior surface 70, and conically shaped divergent passage 72 into the production tubing string, thereby avoiding all contact between the high pressure fluid and any of the control equipment located exteriorly to the production tubing string and the inner mandrel 38.

It will be seen from this description of the operation of the wellhead isolation tool 34, that the well can be placed in communication with high pressure fluids without necessitating the pumping of fluid or mud into the well in a killing operation, high pressures can be obtained within the production tubing string without applying such high pressures to any control equipment, and extremely high rates of flow of sand laden liquid can be transmitted through the wellhead isolation tool 34 into the upper end portion of the production tubing string 16 with a minimum variation is cross-sectional fluid flow area, and a minimum rate of change in fluid flow velocity between the tool and the production tubing string resulting in minimized erosion of the inner surface of the production tubing string. Thus, in treating or fracturing a well having a control cross thereon which is rated at 10,000 psi, an operator can fracture or treat a well at 20,000 psi or higher, and at fluid flow rates well in excess of 10 barrels per minute, without damaging the control equipment or seriously eroding the production tubing string and without killing the well to replace the control equipment or upper end portion of the production tubing string or to bypass the control equipment through conventional means. It is common practice in the oil industry to utilize control heads and control equipment rated at 10,000 psi or less, because the need for any higher pressures so infrequently arises that the utilization of control equipment rated at higher than 10,000 psi would be economically unfeasible. Thus, through the use of the equipment and apparatus disclosed herein, a well can utilize low pressure control head equipment satisfactorily while still permitting the operator to economically and efficiently apply high pressures in high rates of fluid flow to the formation to treat and fracture the well in the formation, and sand laden fracturing fluids can be pumped into the production tubing string at rates of 17 or 18 barrels per minute without serious erosion of the interior of the upper end portion of the production tubing string.

It will be readily understood by those skilled in the art that the operation of the wellhead isolation tool 34 in conjunction with the alternate form of cup assembly 88 illustrated in FIG. 4 will be identical to the operation described in detail above.

Changes may be made in the construction and arrangement of parts or elements of the various embodiments disclosed herein without departing from the spirit and scope of the invention as defined in the following claims.

What is claimed is:

1. In an apparatus for providing fluid communication between the interior of the upper end portion of an oil well production string and a source of high pressure fluid at the surface while isolating the fluid control equipment in the wellhead from high pressure fluids supplied through the apparatus from the source of high pressure fluid, the apparatus being of the type which includes:

elongated tubular housing means for connection in fluid communication with the interior of the wellhead and defining an inner bore therethrough; elongated tubular inner mandrel means, having upper and lower end portions and a longitudinal passage communicating between the upper and lower end portions, concentrically positioned within said elongated tubular housing means in movable fluid sealing engagement therewith with the lower end portion of the inner mandrel means being adapted to extend below said elongated tubular housing means; means for communicating the source of high pressure fluid to the longitudinal passage at the upper end portion of the inner mandrel means; annular seal means carried by said inner mandrel means for providing sealing engagement between said inner mandrel means and the interior of the upper end portion of the oil well production string; and means for moving said inner mandrel means within said elongated tubular housing means to extend said inner mandrel means downwardly through said elongated tubular housing means, and alternately, to extend said inner mandrel means upwardly through said elongated tubular housing means, the improvement comprising:

tubular guide nose means disposed beneath the lower end portion of the inner mandrel means and having an upper end portion, a lower end portion, and a medial portion extending between the upper and lower end portions, the inner diameter of the upper end portion of said tubular guide nose means defining a cross-sectional area substantially equal to the cross-sectional area of the longitudinal passage of the inner mandrel means, the inner diameter of the lower end portion of said tubular guide nose means being substantially equal to the diameter of the interior of the upper end portion of the oil well production string, and the medial portion of said tubular guide nose means defining a frusto-conically shaped inner surface diverging from the axis thereof at an angle of substantially 2 degrees mutually communicating and registering with and extending downwardly from the inner diameter of the upper end portion to communicate and register with the inner diameter of the lower end portion; and means for connecting said tubular guide nose means to the lower end portion of the inner mandrel means with the inner diameter of the upper end portion of said tubular guide nose means coaxially communicating with the longitudinal passage of the inner mandrel means.

2. An apparatus for providing fluid communication between the interior of the upper end portion of an oil well production string and a source of high pressure fluid at the surface while isolating the fluid control equipment in the wellhead from high pressure fluid supplied by the source through the apparatus, comprising in combination:

elongated tubular housing means for connection in fluid communication with the interior of the wellhead and further defining an inner bore therethrough;

elongated inner mandrel means, having upper and lower end portions and a longitudinal bore communicating between the upper and lower end portions, concentrically positioned within said housing means in sealing engagement therewith with the lower end portion of said inner mandrel means being extensible below said housing means;

means for connecting the upper end portion of said inner mandrel means to the source of high pressure fluid;

means for moving said inner mandrel means within said housing means to extend said inner mandrel means downwardly through said housing means;

tubular guide nose means positioned below the lower end portion of said inner mandrel means and having an upper end portion, a lower end portion and a medial portion extending between the upper and lower end portions, the inner diameter of the upper end portion of said tubular guide nose means being substantially equal to the diameter of the bore of said inner mandrel means, the inner diameter of the lower end portion of said tubular guide nose means being approximately equal to the diameter of the interior of the upper end portion of the oil well production string, and the medial portion of said tubular guide nose means defining a conically shaped inner surface diverging from the axis thereof at an angle of substantially 2° mutually communicating and registering with and extending downwardly from the inner diameter of the upper end portion of said tubular guide nose means to communicate and register with the inner diameter of the lower end portion of said tubular guide nose means;

means for connecting said tubular guide nose means to the lower end portion of said inner mandrel means with the inner diameter of the upper end portion of said tubular guide nose means coaxially communicating with the bore of said inner mandrel means; and annular seal means carried by the lower end portion of said inner mandrel means proximate to said tubular guide nose means for providing sealing engagement with the interior of the upper end portion of the oil well production string.

3. In an apparatus for providing fluid communication between the interior of the upper end portion of an oil well production string and a source of high pressure fluid at the surface while isolating the fluid control equipment in the wellhead from high pressure fluids supplied through the apparatus from the source of high pressure fluid, the apparatus being of the type which includes: elongated tubular housing means for connection in fluid communication with the interior of the wellhead and defining an inner bore therethrough; elongated tubular inner mandrel means, having upper and lower end portions and a longitudinal passage communicating between the upper and lower end portions, concentrically positioned within said elongated tubular housing means in movable fluid sealing engagement therewith with the lower end portion of the inner mandrel means being adapted to extend below said elongated tubular housing means; means for communicating the source of high pressure fluid to the longitudinal passage at the upper end portion of the inner mandrel means; annular seal means carried by said inner mandrel means for providing sealing engagement between said inner mandrel means and the interior of the upper end portion of the oil well production string; and means for moving said inner mandrel means within said elongated tubular housing means to extend said inner mandrel means downwardly through said elongated tubular housing means and, alternately, to extend said inner mandrel means upwardly through said elongated tubular housing means; the improvement comprising:

tubular guide nose means disposed beneath the lower end portion of the inner mandrel means and having an upper end portion, a lower end portion, and a medial portion extending between the upper and lower end portions, the inner diameter of the upper end portion of said tubular guide nose means defining a cross-sectional area substantially equal to the cross-sectional area of the longitudinal passage of the inner mandrel means, the inner diameter of the lower end portion of said tubular guide nose means being substantiall equal to the diameter of the interior of the upper end portion of the oil well production string, and the medial portion of said tubular guide nose means defining a frusto-conically shaped inner surface diverging from the axis thereof at an angle of no more than 3° mutually communicating and registering with and extending downwardly from the inner diameter of the upper end portion to communicate and register with the inner diameter of the lower end portion; and means for connecting said tubular guide nose means to the lower end portion of the inner mandrel means with the inner diameter of the upper end portion of said tubular guide nose means coaxially communicating with the longitudinal passage of the inner mandrel means.

4. In an apparatus for providing fluid communication between the interior of the upper end portion of an oil well production string and a source of high pressure fluid at the surface while isolating the fluid control equipment in the wellhead from high pressure fluid, the apparatus being of the type which includes: elongated tubular housing means for connection in fluid communication with the interior of the wellhead and defining an inner bore therethrough; elongated tubular inner mandrel means, having upper and lower end portions and a longitudinal passage communicating between the upper and lower end portions, concentrically positioned within said elongated tubular housing means in movable fluid sealing engagement therewith with the lower end portion of the inner mandrel means being adapted to extend below said elongated tubular housing means; means for communicating the source of high pressure fluid to the longitudinal passage at the upper end portion of the inner mandrel means; and means for moving said inner mandrel means within said elongated tubular housing means to extend said inner mandrel means downwardly through said elongated tubular housing means and, alternately, to extend said inner mandrel means upwardly through said elongated tubular housing means; the improvement comprising:

cup assembly means disposed beneath the lower end portion of the inner mandrel means and having an upper end portion, a lower end portion, and a medial portion extending between the upper and lower end portions, the inner diameter of the upper end portion of said cup assembly means defining a cross-sectional area substantiall equal to the cross-sectional area of the longitudinal passage of the inner mandrel means, the inner diameter of the lower end portion of said cup assembly means being substantially equal to the diameter of the interior of the upper end portion of the oil well production string, and the medial portion of said cup assembly means defining a frustoconically shaped inner surface diverging from the axis thereof at an angle of substantially 2° mutually communicating and registering with and extending downwardly from the inner diameter of the upper end portion to communicate and register with the inner diameter of the lower end portion;

said cup assembly means including a rigid metallic portion extending downwardly from the upper end portion of said cup assembly means;

a resilient and flexible portion extending upwardly from the lower end portion of said cup assembly means and having an annular sealing contact surface formed on the exterior of said resilient and flexible portion proximate the lower end therof;

said annular sealing contact surface having a maximum diameter greater than the diameter of the interior of the upper end portion of the production string thereby resiliently sealingly engaging the interior of the upper end portion of the production string when said annular sealing contact surface is received therein; and a downwardly converging surface formed on the exterior of said resilient and flexible portion extending from said annular sealing contact surface to a lower end face on the lower end portion of said resilient and flexible portion of said cup assembly means, the outer diameter of the lower end face being slightly less than the diameter of the interior of the upper end portion of the production string to thereby faciitate the entrance of said cup assembly means into the production string; and means for fixedly securing said resilient and flexible portion to said rigid portion to form a unitary structure; and means for connecting said cup assembly means to the lower end portion of the inner mandrel means with the inner diameter of the upper end portion of said cup assembly means coaxially communicating with the longitudinal passage of the inner mandrel means.

5. In an apparatus for providing fluid communication between the interior of the upper end portion of an oil well production string and a source of high pressure fluid at the surface while isolating the fluid control equipment in the wellhand from high pressure fluid, the apparatus being of the type which includes: elongated tubular housing means for connection in fluid communication with the interior of the wellhead and defining an inner bore therethrough; elongated tubular inner mandrel means, having upper and lower end portions and a longitudinal passage communicating between the upper and lower end portions, concentrically positioned within said elongated tubular housing means in movable fluid sealing engagement therewith with the lower end portion of the inner mandrel means being adapted to extend below said elongated tubular housing means; means for communicating the source of high pressure fluid to the longitudinal passage at the upper end portion of the inner mandrel means; and means for moving said inner mandrel means within said elongated tubular housing means to extend said inner mandrel means downwardly through said elongated tubular housing means and, alternately, to extend said inner mandrel means upwardly through said elongated tubular housing means; the improvement comprising:

cup assembly means disposed beneath the lower end portion of the inner mandrel means and having an upper end portion, a lower end portion, and a medial portion extending between the upper and lower end portions, the inner diameter of the upper end portion of said cup assembly means defining a cross-sectional area substantially equal to the cross-sectional area of the longitudinal passage of the inner mandrel means, the inner diameter of the lower end portion of said cup assembly means being substantially equal to the diameter of the interior of the upper end portion of the oil well production string, and the medial portion of said cup assembly means defining a frustoconically shaped inner surface diverging from the axis thereof at an angle of no more than 3° mutually communicating and registering with and extending downwardly from the inner diameter of the upper end portion to communicate and register with the inner diameter of the lower end portion;

said cup assembly means including a rigid metallic portion extending downwardly from the upper end portion of said cup assembly means;

a resilient and flexible portion extending upwardly from the lower end portion of said cup assembly means and having an annular sealing contact surface formed on the exterior of said resilient and flexible portion proximate the lower end thereof;

said annular sealing contact surface having a maximum diameter greater than the diameter of the interior of the upper end portion of the production string thereby resiliently sealingly engaging the interior of the upper end portion of the production string when said annular sealing contact surface is received therein; and a downwardly converging surface formed on the exterior of said resilient and flexible portion extending from said annular sealing contact surface to a lower end face on the lower end portion of said resilient and flexible portion of said cup assembly means, the outer diameter of the lower end face being slightly less than the diameter of the interior of the upper end portion of the production string to thereby facilitate the entrance of said cup assembly means into the production string; and means for fixedly securing seaid resilient and flexible portion to said rigid portion to form a unitary structure; and means for connecting said cup assembly means to the lower end portion of the inner mandrel means with the inner diameter of the upper end portion of said cup assembly means coacially communicating with the longitudinal passage of the inner mandrel means.

6. An appataus for providing fluid communication between the interior of the upper end portion of a oil well production string and a source of high pressure fluid at the surface while isolating the fluid control equipment in the wellhand from high pressure fluid supplied by the source through the apparatus, comprising an combination:

elongated tubular housing means for connection in fluid communication with the interior of the wellhead and further defining an inner bore therethrough;

elongated inner mandrel means, having upper and lower end portions and a longitudinal bore communicating between the upper and lower end portions, concentrically positioned within said housing means in sealing engagement therewith with the lower end portion of said inner mandrel means being extensible below said housing means;

means for connecting the upper end portion of said inner mandrel means to the source of high pressure fluid;

means for moving said inner mandrel means within said housing means to extend said inner mandrel means downwardly through said housing means;

tubular guide nose means positioned below the lower end portion of said inner mandrel means and having an upper end portion, a lower end portion and a medial portion extending between the upper and lower end portions, the inner diameter of the upper end portion of said tubular guide nose means being substantially equal to the diameter of the bore of said inner mandrel means, the inner diameter of the lower end portion of said tubular guide nose means being approximately equal to the diameter of the interior of the upper end portion of the oil well production string, and the medial portion of said tubular guide nose means defining a conically shaped inner surface diverging from the axis thereof at an angle of no more than 3° mutually communicating and registering with and extending downwardly from the inner diameter of the upper end portion of said tubular guide nose means to communicate and register with the inner diameter of the lower end portion of said tubular guide nose means;

means for connecting said tubular guide nose means to the lower end portion of said inner mandrel means with the inner diameter of the upper end portion of said tubular guide nose means coaxially communicating with the bore of said inner mandrel means; and annular seal means carried by the lower end portion of said inner mandrel means proximate to said tubular guide nose means for providing sealing engagement with the interior of the upper end portion of the oil well production string.

7. An apparatus for providing fluid communication between the interior of the upper end portion of an oil well production string and a source of high pressure fluid at the surface while isolating the fluid control equipment in the wellhead from high pressure fluid supplied by the source through the apparatus, comprising in combination:

elongated tubular housing means for connection in fluid communication with the interior of the wellhead and further defining an inner bore therethrough;

elongated inner mandrel means, having upper and lower end portions and a longitudinal bore communicating between the upper and lower end portions, concentrically positioned within said housing means in sealing engagement therewith with the lower end portion of said inner mandrel means being extensible below said housing means;

means for connecting the upper end portion of said inner mandrel means to the source of high pressure fluid;

means for moving said inner mandrel means within said housing means to extend said inner mandrel means downwardly through said housing means;

cup assembly means positioned below the lower end portion of said inner mandrel means and having an upper end portion, a lower end portion and a medial portion extending between the upper and lower end portions, the inner diameter of the upper end portion of said cup assembly means being substantially equal to the diameter of the bore of said inner mandrel means, the inner diameter of the lower end portion of said cup assembly means being approximately equal to the diameter of the interior of the upper end portion of the oil well production string, and the medial portion of said cup assembly means defining a conically shaped inner surface diverging from the axis thereof at an angle of substantially 2° mutually communicating and registering with and extending downwardly from the inner diameter of the upper end portion of said cup assembly means to communicate and register with the inner diameter of the lower end portion of said cup assembly means;

said cup assembly means including a rigid metallic portion extending downwardly from the upper end portion of said cup assembly means;

a resilient and flexible portion extending upwardly from the lower end portion of said cup assembly means and having an annular sealing contact surface formed on the exterior of said resilient and flexible portion proximate the lower end thereof;

said annular sealing contact surface having a maximum diameter greater than the diameter of the interior of the upper end portion of the production string thereby resiliently sealingly engaging the interior of the upper end portion of the production string when said annular sealing contact surface is received therein; and a downwardly converging surface formed on the exterior of said resilient and flexible portion extending from said annular sealing contact surface to a lower end face on the lower end portion of said resilient and flexible portion of said resilient and flexible portion of said cup assembly means, the outer diameter of the lower end face being slightly less than the diameter of the interior of the upper end portion of the production string to thereby facilitate the entrance of said cup assembly means into the production string; and means for fixedly securing said resilient and flexible portion to said rigid portion to form a unitary structure; and means for connecting said cup assembly means to the lower end portion of said inner mandrel means with the inner diameter of the upper end portion of said cup assembly means coaxially communicating with the bore of said inner mandrel means.

8. An apparatus for providing fluid communication between the interior of the upper end portion of an oil well production string and a source of high pressure fluid at the surface while isolating the fluid control equipment in the wellhead from high pressure fluid supplied by the source through the apparatus, comprising in combination:

elongated tubular housing means for connection in fluid communication with the interior of the wellhead and further defining an inner bore therethrough;

elongated inner mandrel means, having upper and lower end portions and a longitudinal bore communicating between the upper and lower end portions, concentrically positioned within said housing means in sealing engagement therewith with the lower end portion of said inner mandrel means being extensible below said housing means;

means for connecting the upper end portion of said inner mandrel means to the source of high pressure fluid;

means for moving said inner mandrel means within said housing means to extend said inner mandrel means to extend said inner mandrel means downwardly through said housing means;

cup assembly means positioned below the lower end portion of said inner mandrel means and having an upper end portion, a lower end portion and a medial portion extending between the upper and lower end portions, the inner diameter of the upper end portion of said cup assembly means being substantially equal to the diameter of the bore of said inner mandrel means, the inner diameter of the lower end portion of said cup assembly means being approximately equal to the diameter of the interior of the upper end portion of the oil well production string, and the medial portion of said cup assembly means defining a conically shaped inner surface diverging from the axis thereof at an angle of no more than 3° mutually communicating and registering with and extending downwardly from the inner diameter of the upper end portion of said cup assembly means to communicate and register with the inner diameter of the lower end portion of said cup assembly means;

said cup assembly means including a rigid metallic portion extending downwardly from the upper end portion of said cup assembly means;

a resilient and flexible portion extending upwardly from the lower end portion of said cup assembly means and having an annular sealing contact surface formed on the exterior of said resilient and flexible portion proximate the lower end thereof;

said annular sealing contact surface having a maximum diameter greater than the diameter of the interior of the upper end portion of the production string thereby resiliently sealingly engaging the interior of the upper end portion of the production string when said annular sealing contact surface is received therein; and a downwardly converging surface formed on the exterior of said resilient and flexible portion extending from said annular sealing contact surface to a lower end face on the lower end portion of said resilient and flexible portion of said resilient and flexible portion of said cup assembly means, the outer diameter of the lower end face being slightly less than the diameter of the interior of the upper end portion of the production string to thereby facilitate the entrance of said cup assembly means into the production string; and means for fixedly securing said resilient and flexible portion to said rigid portion to form a unitary structure; and means for connecting said cup assembly means to the lower end portion of said inner mandrel means with the inner diameter of the upper end portion of said cup assembly means coaxially communicating with the bore of said inner mandrel means.

* * * * *